US009774078B2

(12) United States Patent
Margon et al.

(10) Patent No.: US 9,774,078 B2
(45) Date of Patent: Sep. 26, 2017

(54) ANTENNA GROUND PLANE EXTENSION OR ANTENNA EXTENSION ON LANYARD

(71) Applicants: Ken Margon, Oakland, CA (US); Pragash Sangaran, Oakland, CA (US)

(72) Inventors: Ken Margon, Oakland, CA (US); Pragash Sangaran, Oakland, CA (US)

(73) Assignee: Innowave IP Inc., Oakland, CA (US)

( * ) Notice: Subject to any disclaimer, the term of this patent is extended or adjusted under 35 U.S.C. 154(b) by 0 days.

(21) Appl. No.: 14/860,699

(22) Filed: Sep. 21, 2015

(65) Prior Publication Data

US 2016/0164179 A1 Jun. 9, 2016

Related U.S. Application Data

(60) Provisional application No. 62/052,823, filed on Sep. 19, 2014.

(51) Int. Cl.

| | |
|---|---|
| ***H01Q 9/04*** | (2006.01) |
| ***H01Q 1/48*** | (2006.01) |
| ***H01Q 1/24*** | (2006.01) |
| ***H01Q 1/44*** | (2006.01) |
| ***H01Q 9/14*** | (2006.01) |
| ***H01Q 9/42*** | (2006.01) |

(52) U.S. Cl.

CPC ..... *H01Q 1/48* (2013.01); *H01Q 1/242* (2013.01); *H01Q 1/44* (2013.01); *H01Q 9/14* (2013.01); *H01Q 9/42* (2013.01)

(58) Field of Classification Search

CPC ..... H01Q 9/04; H01Q 1/48; H01Q 1/12

See application file for complete search history.

(56) References Cited

U.S. PATENT DOCUMENTS

| | | | | |
|---|---|---|---|---|
| 2007/0164912 | A1* | 7/2007 | Yanagi | H01Q 1/273 343/702 |
| 2011/0304520 | A1* | 12/2011 | Djordjevic | H01Q 21/0087 343/893 |
| 2013/0017786 | A1* | 1/2013 | Kvist | H01Q 1/243 455/41.2 |

* cited by examiner

*Primary Examiner* — Dameon E Levi
*Assistant Examiner* — Andrea Lindgren Baltzell
(74) *Attorney, Agent, or Firm* — San Diego IP Law Group LLP; Trevor Coddington

(57) ABSTRACT

The present invention provides a technique to optimize and/or extend the length of an antenna arm or antenna ground plane for communications components contained in a printed circuit board (PCB) within a communications device. In an embodiment of the invention, an antenna arm or ground plane extension is provided as part of a lanyard for holding the communications device. For example, the lanyard comprises a cord passed around the neck, shoulder, or wrist. The cord comprises an electrical conductor coupled to the communications components. The electrical conductor serves as the antenna arm or ground plane. The length of the PCB need not to be extended to improve antenna efficiency and gain. Ideally, the lanyard antenna extension is ideally coplanar with the PCB. Careful lanyard material selection determines the most efficient and practical wavelength or resonance length of the antenna.

9 Claims, 5 Drawing Sheets

ANTENNA GROUND PLANE EXTENSION OR ANTENNA EXTENSION ON LANYARD

CROSS-REFERENCE TO RELATED APPLICATION

The present application claims priority to U.S. Provisional Patent Application No. 62/052,823, filed on Sep. 19, 2014, entitled "Method to Design Optimum Antenna Ground Plane Extension or Antenna Extension on Lanyard" the entire disclosure of which is incorporated by reference herein.

BACKGROUND OF THE INVENTION

1. Field of Invention

This invention relates generally to radio frequency (RF) and microwave communications and more specifically, to an improved antenna design for RF and microwave communication devices.

2. Description of Related Art

Generally, an antenna can be modeled as a half wave dipole antenna. The length of a half wave dipole antenna is equal to a half-wavelength at the frequency of operation. A dipole antenna, spiral antenna, bow tie antenna, and log-periodic antenna have two arms. Other types of antennas, such as a monopole antenna, planar inverted-F antenna (PIFA) antenna, helix antenna, and patch antenna have a single arm, but the ground plane acts as a second arm for it to radiate.

Cellular phone and communication device manufacturers are struggling to meet over-the air (OTA) performance requirements due to antenna limitations. To provide the best antenna, antenna length has to be large, but large antennas cannot be accommodated into small devices. Conventional techniques fold or bend the antenna to save space, but the trade-off is decreased antenna efficiency, bandwidth, and gain.

Today's communication devices have to meet customer preferences by being sophisticated, easy to operate, and portable, i.e., small in size. Designing a small communication device is a huge challenge for low frequency operations. Radio frequency (RF) (e.g., 30 Hz-3 GHz) and microwave frequency (3 GHz-300 GHz) operation makes it impossible to have adequate antenna efficiency, gain, and bandwidth if not enough antenna arm length is provided for a dipole antenna or not enough ground plane length is provided for monopole, PIFA, or circular antenna. For the purposes of simplifying the present disclosure, reference to radio waves or RF includes microwaves or microwave frequencies.

Therefore, there exists a need to optimize antenna design in small form factor communications devices operating at low frequencies.

SUMMARY OF THE INVENTION

The present invention overcomes these and other deficiencies of the prior art by providing a technique to optimize and/or extend the length of an antenna arm or antenna ground plane for communications components contained in a printed circuit board (PCB) within a communications device. In an embodiment of the invention, an antenna arm or ground plane extension is provided as part of a lanyard for holding the communications device. For example, the lanyard comprises a cord passed around the neck, shoulder, or wrist. The cord comprises an electrical conductor coupled to the communications components. The electrical conductor serves as the antenna arm or ground plane. The length of the PCB need not to be extended to improve antenna efficiency and gain. Ideally, the lanyard antenna extension is ideally coplanar with the PCB. Careful lanyard material selection determines the most efficient and practical wavelength or resonance length of the antenna.

In an embodiment of the invention, a radio frequency (RF) communications device comprises: a printed circuit board (PCB) comprising communication electronics to transmit or receive a radio frequency communications signal at a first frequency; a lanyard comprising a conductor having a length that is equal to a resonant wavelength of the conductor at the first frequency, a half of the resonant wavelength, or a quarter of the resonant wavelength, wherein the conductor is electronically coupled to the communications electronics and serves as an antenna arm extension or a ground plane extension. The PCB can be a flexible PCB. The first frequency is selected from the group consisting of: a VHF frequency, a ZigBee frequency, a Bluetooth frequency, a WiFi frequency, a 3G cellular frequency, and a 4G cellular frequency. The conductor can be gold, silver, platinum, steel, tungsten, brass, or aluminum, if not copper. The conductor can comprise an insulator core with a metallic surface. The device may further comprise a sensor for determining whether the conductor has been bent. Alternatively, the conductor comprises a first conductor and a second conductor, wherein the first conductor is connected to a ground of the PCB and the second conductor is coupled to a transmitter or receiver within the communications electronics. The lanyard can comprise a slender flexible material having two ends, wherein one end houses the conductor. The other end can houses a second conductor. Alternatively, both ends house the conductor.

An advantage of the present invention is that it reduces the size of the communications device size of the communications device. The size of the communications device is reduced drastically since the antenna in the PCB board can be replaced by the conductor in the lanyard to extend the antenna/ground plane. By selecting conductor and insulator material carefully, wave length/resonance length of an antenna can be controlled and antenna efficiency, gain, and bandwidth can be optimized.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
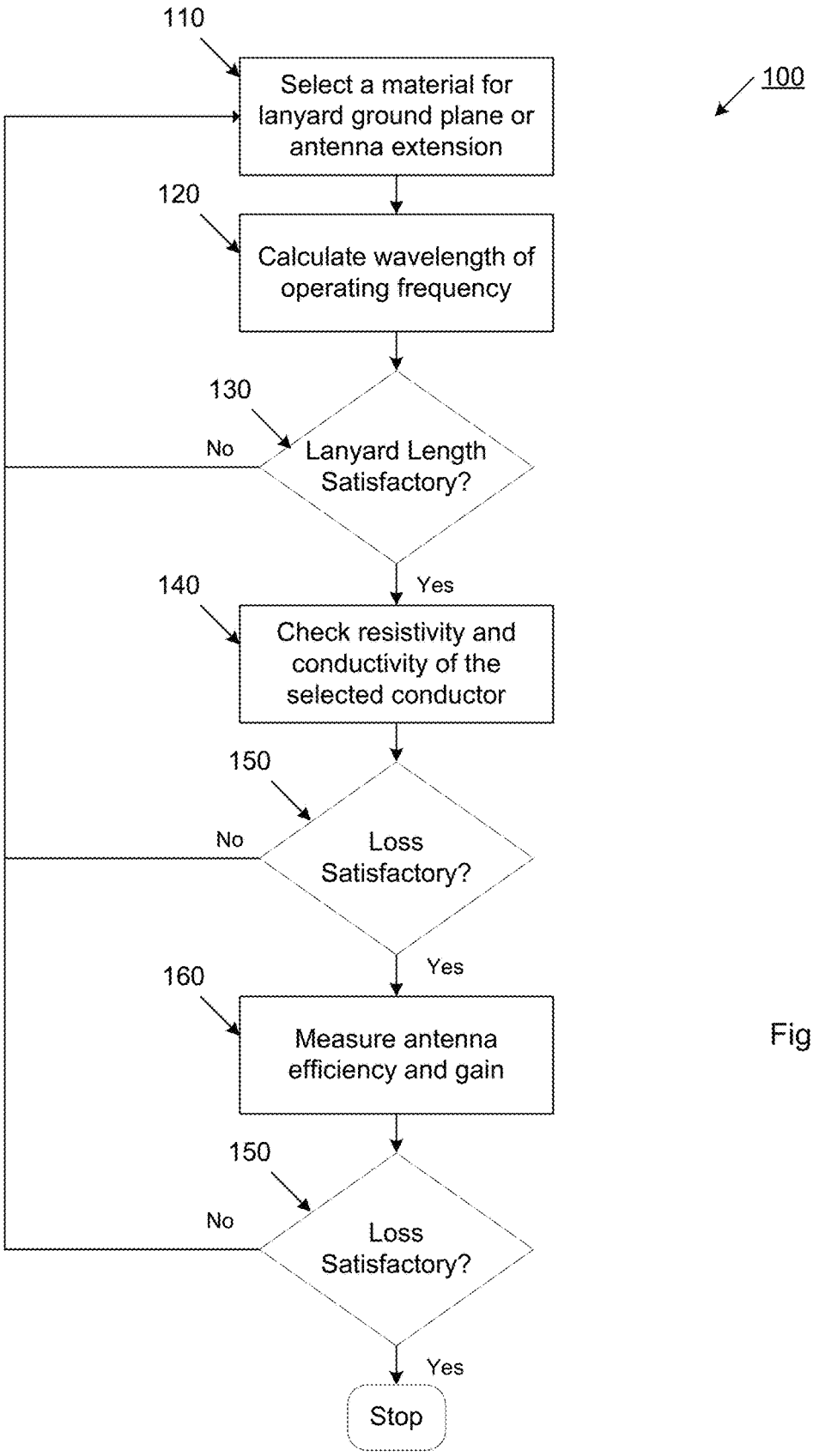
FIG. 1 illustrates a method for selecting a material for a lanyard ground plane or antenna extension according to an embodiment of the invention.

Preferred embodiments of the present invention and their advantages may be understood by referring to FIGS. 1-5, wherein like reference numerals refer to like elements. Although the present invention is described in the context of a mobile communications device, the inventive concepts disclosed and claimed are equally applicable to fixed communications devices. Examples of communications devices include, but are not limited to IEEE 802.11 communications devices, cellular telephones, global positioning system (GPS) communications devices, worldwide interoperability for microwave access (WiMAX) communications devices, Bluetooth communications devices, and Zigbee communications devices. Regardless of the communications protocol implemented, the present invention provides a technique for optimizing antenna length and material for small form factor communication devices.

In an embodiment of the invention, the present invention improves the antenna performance of communications components facilitated on a printed circuit board (PCB). The PCB comprises radio frequency (RF) modules, controller modules, inductors, capacitors, resistors, etc. (collectively or sub-collectively, "communications electronics") and is housed within a larger communications device (including a wearable device) such as, but not limited to a wireless physiology monitor, pendant, smartphone, smart ring, smart bracelet, or smartwatch Implementation and/or identification of the PCB for a particular communications application is readily apparent to one of ordinary skill in the art and is therefore not discussed in detail here. An example wireless physiology monitor is described in U.S. Pat. Nos. 8,999,536 and 9,035,775, the disclosures of which are incorporated by reference herein in their entireties. The PCB can be a rigid, flexible PCB, or Kapton PCB, the identification and implementation of which are apparent to one of ordinary skill in the art.

The present invention improves the performance of an antenna included as part of the PCB, however it can also serve as a standalone antenna that connects to the PCB without an antenna, e.g., connecting to an RF transmitter and/or receiver (collectively, referred to as a transceiver) provided on the PCB. In the latter case, the present invention comprises a lanyard having a built-in antenna that is connected to the transceiver of the PCB. For small form fact communications devices, an antenna constrained on the PCB alone may not pass certification testing. Therefore, a PCB can be designed with a lanyard based antenna or ground plane extension included therein. However, if a PCB having a built-in antenna failed certification because of poor antenna efficiency, improved antenna can be obtained via an antenna or ground plane extension provided by the lanyard. The lanyard can be used to minimize PCB size and the overall form factor of the communication device. The term "lanyard" has a special meaning as used herein and denotes any type (including any form factor or material) of housing for an antenna extension and/or ground plane extension. As used herein, the term "lanyard" is not limited to a cord or strap to hold something. For example, a ring shank could be considered a lanyard for purposes of this disclosure.

Antenna length is typically equal to a quarter wavelength or half wavelength of the radio wave depending on the antenna configuration. The wavelength, λ, of electromagnetic radiation is:

$$\lambda = \frac{v}{f}$$

where v is the velocity (i.e., wave propagation speed) and f is the frequency. In a vacuum, v is equal to the speed of light, c ($3\times10^8$ m/s). However, wave propagation speed depends upon the medium in which it propagates. The speed, v, of electromagnetic radiation in a given medium is:

$$v = \frac{c}{\sqrt{\varepsilon_r \mu_r}}$$

where $\in_r$ is the relative permeability of the medium and $\mu_r$ is the relative permittivity of the medium. According, the wavelength/resonance length of an antenna (and hence the antenna efficiency, gain, and bandwidth) can be controlled by carefully selecting the antenna medium.

In an embodiment of the invention, a lanyard comprises a conductor serving as an antenna or ground plane extension, which is coupled to a PCB equipped with communications electronics. Different conductors have different resistivity. A material with a relatively low resistivity will have relatively low loss—a material with a relative high resistivity will have relatively high loss. In an embodiment of the invention, the lanyard comprises a conductor embedded within a dielectric material. This conductor material can be any type of conductor such as, but not limited to solid copper, gold, silver, brass, aluminum, tungsten, platinum, or steel, or a composite material such as conductor material plated on a non-conductor, e.g., an expensive material such as gold, silver, or platinum deposited on an inexpensive material such as carbon, fiberglass, or silicon. The dielectric material can be any type of insulator such as, but not limited to nylon, plastic, air, and ceramic. By selecting the conductor material, the resonance (frequency) (i.e., frequency with highest antenna efficiency) of the antenna can be controlled and optimized to best match the communications frequency.

For low band communication devices such as VHF (136M Hz to 174M Hz—television or military radio communication), a relatively long wavelength is needed. Table I compares the wavelengths of steel, copper, and aluminum operating at 150 MHz and 850 MHz (e.g., Global System for Mobile Communications, GSM), respectively. PCB conductor material is typically copper.

TABLE 1

Wavelengths of Select Materials

| Material | 150 MHz | 850 MHz |
|---|---|---|
| Steel | 13.4 mm | 2.372 mm |
| Copper | 950.287 mm | 167.69 mm |
| Aluminum | 950.287 mm | 167.69 mm |

For this example, the dielectric of the lanyard was FR-4 and the conductor of the lanyard was varied among steel, cooper, and aluminum. In an embodiment of the invention, the dielectric can be varied as well. In an exemplary embodiment of the invention, a VHF radio is provided on the PCB and operates at 150 MHz. The PCB conductor is copper with FR-4 dielectric so the wavelength at 150 MHz is 950.3 mm. A PIFA antenna is used so quarter wavelength ground (antenna length) has to be 237.55 mm. The radio components and antenna are mounted on PCB so the ground plane of the PCB acts as a ground plane of antenna. In this case, it is that a lanyard extension is needed because it is impractical to include a 237.55 length antenna on the PCB in a small form factor communications device. In another exemplary embodiment of the invention, the lanyard conductor is steel, the antenna length is reduced to 3.35 mm (quarter wavelength). Each conductor material has different conductivity and resistivity. By carefully selecting the conductor material for antenna ground plane or antenna extension, antenna efficiency and gain can be optimized while meeting form factor requirements. Material with low resistivity will have high antenna efficiency and gain, and vice versa.

FIG. 1 illustrates a method 100 for selecting a material for a lanyard ground plane or antenna extension according to an embodiment of the invention. The method 100 begins by selecting (step 110) a material for a lanyard ground plane or antenna extension. The wavelength of the resonant antenna frequency is calculated (step 120) using the selected material's relative permeability and relative permittivity. The antenna length for the lanyard will be either a quarter, half, or entire wavelength of the radio wave. Generally, an antenna comprises two arms. For a dipole antenna, spiral antenna, bow tie antenna, and log periodic antenna, each arm has a length equal to a quarter wavelength. Monopole, patch, PIFA antenna, helix antenna also have two arms, but one arm is a quarter wavelength antenna whereas the other arm is quarter wavelength ground plane. Over extending the ground plane length or antenna length beyond quarter wave length degrades the performance or shifts the performance to a lower frequency. Based on the above wavelength equation, wavelength is indirectly proportional to frequency. If the arm length or wavelength of the antenna is extended too much, it will shift the antenna resonance frequency to a lower frequency. If it is shortened too much, it will shift the antenna resonance frequency to a higher frequency.

The antenna length is then determined (step 130) whether it is satisfactory, i.e., practical for the particular communications application. For example, a smart ring with 3G mobile communications connectivity is the communications device. In order for its antenna to resonate at GSM low band (850 MHz), the dipole antenna length has to be 83.84 mm (half wavelength). The width of the ring is approximately 6 mm. The 3G PCB module is 2 mm in length. The balance, 81.84 mm, must be provided by the conductor in the lanyard, which for this context is the ring shank (sometimes mistakenly referred to as the band). However, a smart ring with a 81.84 mm ring shank is impractical for most, if not all, humans. By changing the antenna material from copper to steel, wavelength is drastically reduced to 2.37 mm. Due to this reduction, the ring shank length becomes practical and the lanyard antenna or ground plane extension can be implemented was part of the ring shank. For example, the ring shank can be constructed from an insulator such as plastic. The ring shank comprises a steel antenna, which is coupled to the 3G PCB.

If the antenna length is not satisfactory, then a new material is selected (step 110). If the antenna length is satisfactory, the resistivity and conductivity is checked (step 140). The return loss is then determined (step 150) whether it meets a predetermined threshold. If the return loss is not satisfactory, then a new material is selected (step 110) and the method 100 starts over. If the return loss is satisfactory, antenna efficiency and gain are measured (step 160), the implementation of which is apparent to one of ordinary skill in the art. If the measured antenna efficiency and gain are not satisfactory, then a new material is selected (step 110) and the method 100 starts over. Otherwise, the material selected is suitable for a lanyard ground plane or antenna extension.

Since velocity of the wave is inversely proportional to permeability and permittivity of conductor and insulator material, if a higher permittivity material is selected as an insulator (higher permittivity than FR-4 since FR-4 is the usual dielectric for PCB) and higher permeability material as conductor (possibly higher than copper as copper will be the conductor for PCB usually), wavelength can be significantly reduced. In an exemplary embodiment of the invention, the ground wire of the PCB ground is copper. If a ground plane extension is connected to the PCB ground, but is not copper, the resonance frequency will shift up or down depending on permeability of the extension material. If the ground plane extension material has a higher permeability than that of cooper, the wavelength will decrease and resonance shifts down in frequency. If the ground plane extension has a lower permeability than that of cooper, the wavelength will increase and resonance shifts up in frequency.

Figure 2:
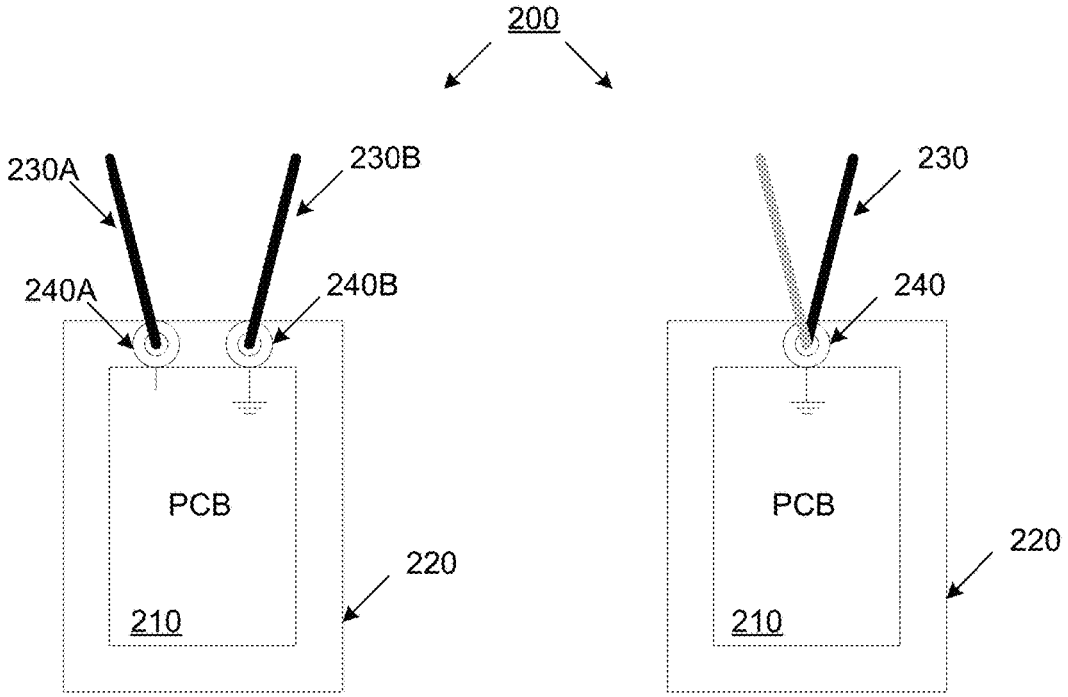
FIG. 2 illustrates a ground plane extension system according to an embodiment of the invention.

FIG. 2 illustrates a ground plane extension system 200 according to an embodiment of the invention. Here, a PCB 210 is housed within a wireless communications device 220. A ground plane or antenna extension 230 is connected to the PCB's ground via a connector 240. The connector 240 can be any type of connector including, but not limited to a pogo pin, soldered wire, plug, or screws, the implementation of which are apparent to one of ordinary skill in the art. On the left side of the figure, a two-connector system is shown. Connector 240A is coupled to the RF transceiver (not shown) of PCB 210—lanyard 250 includes antenna extension 230A coupled to connector 240A. Connector 240B is coupled to the ground of the PCB 210—lanyard 250 includes ground plane extension 230B coupled to connector 240B. The ground plane extension 230 can be made of any material such as stainless steel chain, copper wire, brass wire and etc., depending on the operating frequency of the RF transceiver. The connector 240A or 240B can be any type of conductor such as brass, aluminum, or steel, but is most preferably the same material as the respective antenna extension 230A or ground plane extension 230B. On the right side of the figure, a single connector system is shown. Here, connector 240 is coupled to the ground of the PCB 210. Lanyard 250 comprises a ground plane extension 230 coupled to the connector 240.

Figure 3:
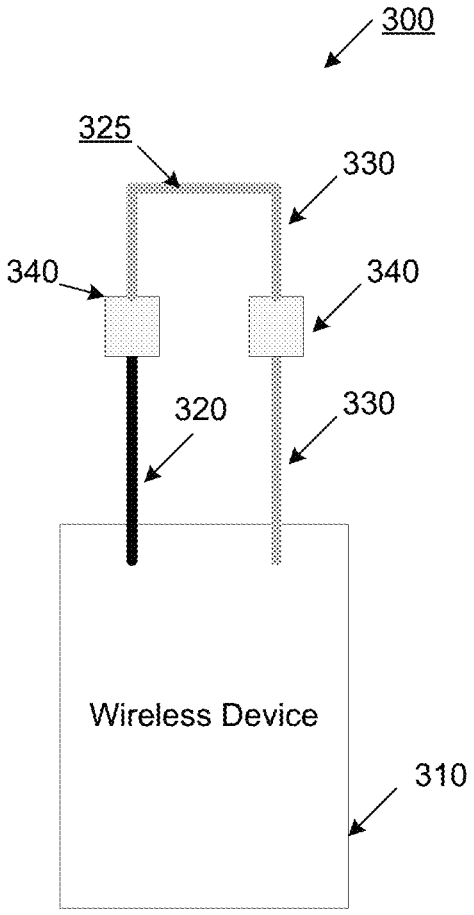
FIG. 3 illustrates a one side ground plane extension system according to an embodiment of the invention.

FIG. 3 illustrates a one sided ground plane extension system 300 according to an embodiment of the invention. Here, a wireless device 310 is coupled to a conductive ground plane extension 320, i.e., conductor. The ground plane extension 320 is included as part of a lanyard 325 that can be worn, for example, around a user's neck, and comprises a non-conductive material 330. Optional hardware 340 may be included to adjust the overall length of the lanyard 325. Although in other embodiments, the lanyard 325 can be worn around a hand, hip, or hooked to a belt via a clip.

Figure 4:
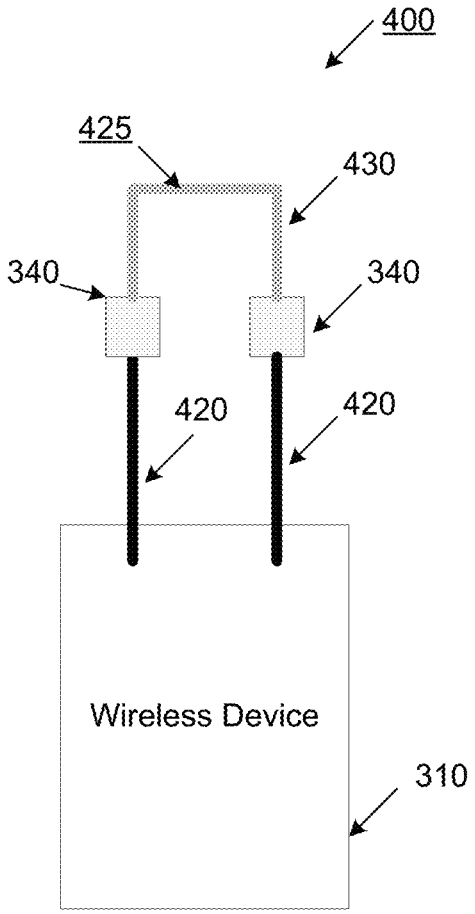
FIG. 4 illustrates a two sided ground plane extension system according to another embodiment of the invention.

FIG. 4 illustrates a two sided ground plane extension system 400 according to another embodiment of the invention. Here, the wireless device 310 is coupled to two conductive ground plane extensions 420. The ground plane extensions 420 are included as part of a lanyard 425, which comprises non-conductive material 430.

Figure 5:
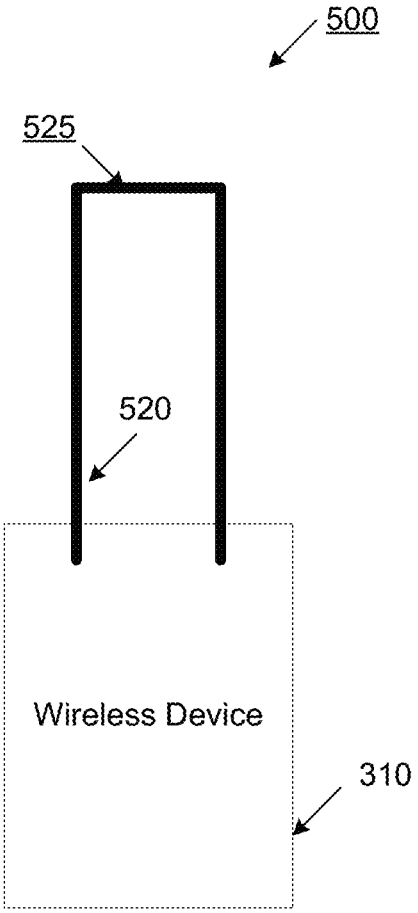
FIG. 5 illustrates a full lanyard ground plane extension system according to another embodiment of the invention.

FIG. 5 illustrates a full lanyard ground plane extension system 500 according to another embodiment of the invention. Here, a wireless device 310 is coupled to a conductive ground plane extension 520 as part of a lanyard 525. The wavelength required for the antenna to radiate efficiently is the relative length of the lanyard and not the complete length of the lanyard. Relative length along the ground plane not the running (measured) length of the lanyard material. Material should be selected so that the variation and frequency shift that can occur, maintains the efficiency requirements within tolerance for the antenna in the band of interest. In some cases such as a wrist strap it may be made more rigid in order to maintain the antenna within the maintains the efficiency requirements within tolerance. The advantage of having full lanyard ground extension is the lanyard is easy to manufacture and manufacturing cost will be cheaper due to less complexity. The conductive ground plane extension 520 is embedded inside a non-conductive material such as plastic, etc.

In a preferred embodiment, the lanyard extension is ideally coplanar to the PCB. Lanyard antenna extension can be in the different plane with the PCB or antenna as well. Bending the lanyard will degrade antenna performance, i.e., bandwidth and gain. The antenna performs best when the lanyard is placed horizontal or on the same plane to device PCB. Device use case can specify this so user is aware. For example, via a user manual, the manufacturer can state recommended usage condition and impact of bending the lanyard. Bending the antenna will have a significant impact for low band technologies such as UHF radio signals (DVB-H mobile TV), 3G and LTE whereas ISM band technologies (higher frequencies) will have little impact. In an embodiment of the invention, a detector is implemented to detect lanyard condition, i.e., whether lanyard is bent or straight. For example, an RF to DC converter sensor is employed to sense reduction/variation in DC voltage. In an embodiment of the invention, if lanyard is bent, a voice alert will be played in the accompanying device. Voice alert will instruct user to correct the lanyard position or not to bend it.

If a plurality of technologies are enabled in the device 310 such as, but not limited to UHF radio signals (DVB-H mobile TV), 3G, LTE, WiFi, Bluetooth, and/or ZigBee, etc., the ground plane length is preferably determined as above using the lowest frequency band in all available technologies.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A radio frequency (RF) communications device comprising:

a printed circuit board (PCB) comprising communication electronics to transmit or receive a radio frequency communications signal at a first frequency;

a lanyard comprising a conductor having a fixed length, wherein the fixed length is equal to a predetermined resonant wavelength of the conductor at the first frequency, a half of the predetermined resonant wavelength of the conductor at the first frequency, or a quarter of the predetermined resonant wavelength of the conductor at the first frequency, the predetermined resonant wavelength being dependent on permeability and permittivity of the conductor and the first frequency, wherein the conductor is electronically coupled to the communications electronics and serves as an antenna arm extension or a ground plane extension.

2. The RF communications device of claim 1, wherein the PCB is a flexible PCB.

3. The RF communications device of claim 1, wherein the first frequency is selected from the group consisting of: a VHF frequency, a ZigBee frequency, a Bluetooth frequency, a WiFi frequency, a 3G cellular frequency, and a 4G cellular frequency.

4. The RF communications device of claim 1, wherein the conductor comprises a material selected from the group consisting of: gold, silver, platinum, steel, tungsten, brass, and aluminum.

5. The RF communications device of claim 1, wherein the conductor comprises an insulator core with a metallic surface.

6. The RF communications device of claim 1, further comprising a sensor for determining whether the conductor has been bent.

7. The RF communications device of claim 1, wherein the conductor comprises a first conductor and a second conductor, wherein the first conductor is connected to a ground of the PCB and the second conductor is coupled to a transmitter or receiver within the communications electronics.

8. The RF communications device of claim 1, wherein the lanyard comprises a slender flexible material having a first end and a second end, wherein the first end houses the first conductor.

9. The RF communications device of claim 8, wherein the second end houses the second conductor.

* * * * *